US009096355B2

(12) United States Patent
Jensen

(10) Patent No.: US 9,096,355 B2
(45) Date of Patent: Aug. 4, 2015

(54) FLAME ARRESTING AND DISPENSING CAP FOR GEL AND LIQUID FUELS FOR VENTLESS FIREPLACES

(75) Inventor: Seth Jensen, Racine, WI (US)

(73) Assignee: Jensen Metal Products, Inc., Racine, WI (US)

( * ) Notice: Subject to any disclaimer, the term of this patent is extended or adjusted under 35 U.S.C. 154(b) by 121 days.

(21) Appl. No.: 13/269,732

(22) Filed: Oct. 10, 2011

(65) Prior Publication Data

US 2013/0087581 A1 Apr. 11, 2013

(51) Int. Cl.

| | |
|---|---|
| ***B67D 7/76*** | (2010.01) |
| ***B65D 47/00*** | (2006.01) |
| ***B67D 3/00*** | (2006.01) |
| ***F17D 3/00*** | (2006.01) |
| ***B65D 47/04*** | (2006.01) |
| *B65D 25/38* | (2006.01) |

(52) U.S. Cl.

CPC ..... *B65D 47/043* (2013.01); *B65D 25/385* (2013.01)

(58) Field of Classification Search

CPC ..... B67D 7/06; B65D 25/385; B65D 47/043
USPC ..... 222/189.01, 547; 220/88.2, 203.11, 220/714, 256.1, 259.3; 48/192; 215/11.4, 215/260, 311, 43–45; 431/353
See application file for complete search history.

(56) References Cited

U.S. PATENT DOCUMENTS

| | | | | | |
|---|---|---|---|---|---|
| 45,340 | A | * | 12/1864 | Perkins et al. | 222/189.01 |
| 48,585 | A | * | 7/1865 | Perkins et al. | 48/192 |
| 141,224 | A | * | 7/1873 | House | 222/189.01 |
| 855,525 | A | * | 6/1907 | McNutt | 222/189.01 |
| 900,763 | A | * | 10/1908 | McNutt | 220/373 |
| 1,122,624 | A | * | 12/1914 | McNutt | 222/189.01 |
| 1,670,147 | A | * | 5/1928 | Gault, Jr. | 431/353 |
| 2,052,728 | A | * | 9/1936 | Stewart | 215/276 |
| 3,047,195 | A | * | 7/1962 | Richmond | 222/570 |
| 4,706,829 | A | * | 11/1987 | Li | 215/354 |
| 4,767,016 | A | | 8/1988 | Cook, Jr. et al. | |

(Continued)

FOREIGN PATENT DOCUMENTS

| | | | |
|---|---|---|---|
| CH | 95485 | A * | 7/1922 |
| EP | 588765 | B1 * | 2/1996 |

OTHER PUBLICATIONS

Mannan, Sam and Frank P. Lees, Lees' Loss Prevention in the Process Industries, 2005, Elsevier Inc, 3rd Edition, vol. 2, p. 17/56.*

(Continued)

*Primary Examiner* — Frederick C Nicolas
*Assistant Examiner* — Matthew Lembo
(74) *Attorney, Agent, or Firm* — Jansson Munger McKinley and Shape Ltd.

(57) ABSTRACT

A container-mounted dispensing structure for dispensing gel or liquid fuel into a fuel-containment reservoir of a ventless fireplace. The dispensing structure having an upstream member and a downstream member which are connected to each other. The upstream member defining a plurality of flame-restricting apertures through which fuel exits the container. The downstream member having a substantially larger dispensing aperture. The number of flame-restricting apertures and their size being selected to prevent flame ingress into the container and to allow sufficient flow into a manifold to facilitate single-stream, splash-free flow of fuel from the dispensing aperture into the reservoir.

24 Claims, 8 Drawing Sheets

(56) References Cited

U.S. PATENT DOCUMENTS

| | | | | |
|---|---|---|---|---|
| 4,892,209 | A | 1/1990 | Dorfman et al. | |
| 5,417,860 | A * | 5/1995 | Kay | 210/472 |
| 2011/0000870 | A1 * | 1/2011 | Dubach | 215/228 |

OTHER PUBLICATIONS

Grossel, Stanley S., Deflagration and Detonation Arresters, 2002, American Institute of Chemical Engineers, Section 5, pp. 78-86.*

* cited by examiner

FLAME ARRESTING AND DISPENSING CAP FOR GEL AND LIQUID FUELS FOR VENTLESS FIREPLACES

FIELD OF THE INVENTION

This invention is related generally to indoor-outdoor fireplace apparatus of the type which utilize gel or liquid fuel and, more specifically, dispensers for gel or liquid fuel used in such fireplace apparatus.

BACKGROUND OF THE INVENTION

So-called "ventless fireplaces," i.e., fireplaces which burn gel or liquid fuel, exist in a variety of forms. Such fireplaces typically have several advantages over various more-traditional fireplaces in that ventless fireplaces cleanly burn their fuel, are often portable, and may not require installation. Such fireplaces burn gel or liquid fuel that is dispensed from a fuel container into a fuel reservoir where the burning occurs.

In the ventless fireplace field, there is a need for an improved fuel dispensing cap for gel and liquid fuels for use in a variety of ventless fireplace applications. Fuel dispensing caps of the prior art have a number of shortcomings. One such shortcoming is that such caps do not have features which allow for normal flow of fuel during filling while also preventing dangerous flame ingress into the fuel container because of improper or careless useage in dispensing fuel. Another shortcoming is that caps of the prior art, because of features which restrict flow, typically do not allow a flow rate which is deemed satisfactory by some users. As a result, some customers may dangerously tinker and modify the fuel cap to increase flow rate, and depending on how this is done it can lead to loss of control of flow or possible flame ingress into the fuel container.

Examples of prior art dispensing caps for flammable liquid include caps which dispense a plurality (e.g. three) of tiny streams onto charcoal. Such caps are usually deemed unsatisfactory for dispensing fuel for ventless fireplaces because of insufficient flow. Examples of other prior art dispensing caps for liquid are disclosed in the following United States patents: U.S. Pat. No. 4,892,209 (Dorfman, et al.) and U.S. Pat. No. 4,767,016 (Cook, Jr., et al.).

Many fuel caps of the prior art are also not permanent or durable enough to last for the life of the fuel container. It is desirable to have a fuel cap which has a satisfactory flow rate, avoids flame ingress, and is durable.

This invention overcomes certain problems and shortcomings in the prior art, including those mentioned above and others, and provides advantages not previously provided for fuel dispensing for indoor-outdoor ventless fireplaces.

SUMMARY OF THE INVENTION

This invention is an improvement in indoor-outdoor fireplace apparatus of the type which utilize gel or liquid fuel and, more specifically, dispensers for gel or liquid fuel used in such fireplace apparatus. The invention overcomes the problems of the prior art described above.

In the invention, the container-mounted dispensing structure for dispensing gel or liquid fuel into a fuel-containment reservoir of a ventless fireplace has an upstream member and a downstream member. The upstream member has a plurality of flame-restricting apertures through which fuel passes from the container in sufficient quantity because of the number of small apertures, and the downstream member defines a substantially larger dispensing aperture for dispensing the fuel in a larger well-controlled stream into the fuel reservoir of the ventless fireplace. The downstream member is connected to the upstream member and together they form a fuel-gathering manifold therebetween. The number of flame-restricting apertures in the upstream member is selected for sufficient total flow and the size of such apertures is selected to prevent flame ingress into the container. This configuration allows for single-stream, splash-free flow of fuel from the dispensing aperture in the downstream member into the reservoir.

In a highly preferred embodiment, the upstream member and downstream member have annular sidewalls sized such that the upstream member is friction-engaged with the downstream member. Preferably, the sidewall of the downstream member is sized for friction engagement in the neck of the container. It is preferred that the downstream member include an outward flange positioned for engagement with the lip of the container.

In some preferred embodiments, the inner diameter of the flame-restricting apertures is about 0.05-0.06 inches. It is highly preferred that the inner diameter of the flame-restricting apertures be about 0.058 inches. It is also highly preferred that the upstream member have at least six flame-restricting apertures of such small size. In some preferred embodiments, the inner diameter of the dispensing aperture is about 0.25-0.4 inches. It is highly preferred that the inner diameter of the dispensing aperture be about 0.35 inches.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF PREFERRED EMBODIMENTS

Figure 1:
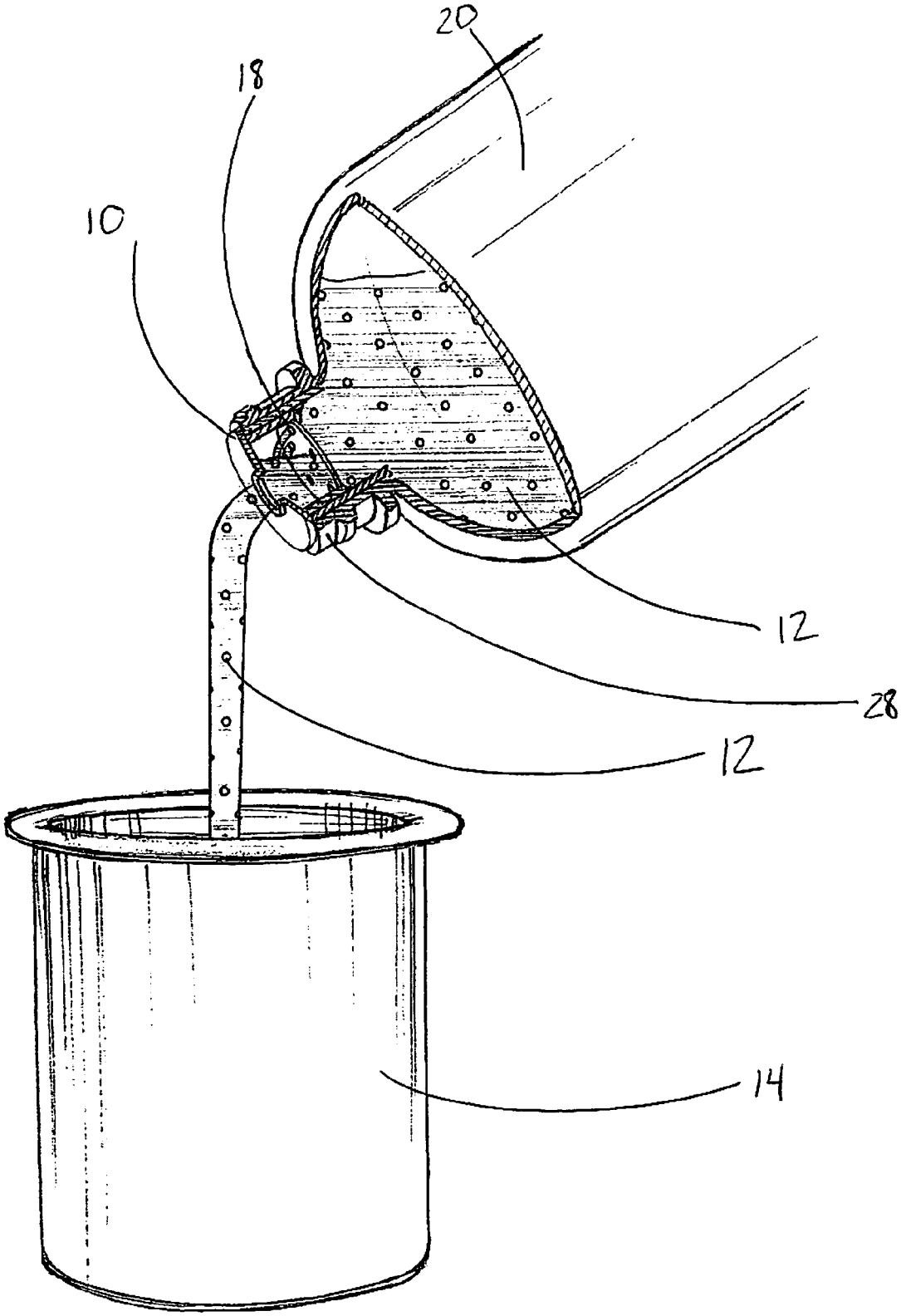
FIG. 1 is a partially sectional perspective view of a container-mounted dispensing structure dispensing fuel into a fuel-containment reservoir of a ventless fireplace.

As shown in FIGS. 1-9, this invention is a container-mounted dispensing structure 10 for dispensing gel or liquid fuel 12 into a fuel-containment reservoir 14 of a ventless fireplace. Container-mounted dispensing structure 10 includes an upstream member 16 defining a plurality of flame-restricting apertures 18 through which fuel 12 exits a fuel container 20. Container-mounted dispensing structure 10 also includes a downstream member 22 connected to upstream member 16 and defining a substantially larger dispensing aperture 24 from which fuel 12 is dispensed. Upstream member 16 and downstream member 22 together form a fuel-gathering manifold 26. The number of flame-restricting apertures 18 and the size of such apertures 18 is selected to prevent flame ingress into fuel container 20 and to allow sufficient fuel 12 flow into the manifold 26 to facilitate single-stream, splash-free flow of fuel 12 from dispensing aperture 24 into reservoir 14.

Figure 6:
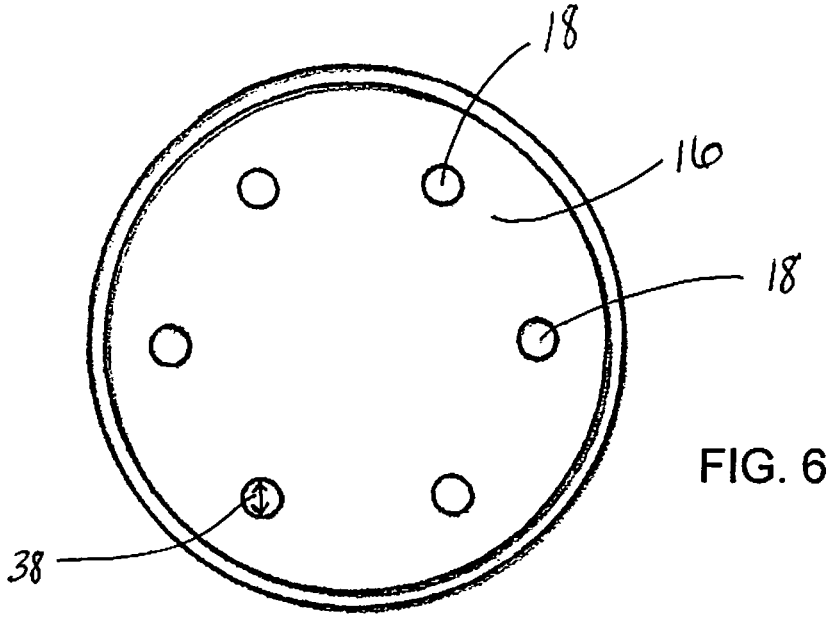
FIG. 6 is a top view of the upstream member with its flame-restricting apertures.

FIG. 1 illustrates the interaction between the upstream member 16 and the downstream member 22 as well as shows the flow of fuel 12 from fuel container 20 into fuel-containment reservoir 14 of a ventless fireplace. FIGS. 1 and 6 illustrate that upstream member 16 has at least six flame-restricting apertures 18. In some embodiments, upstream member 16 may have more or less flame-restricting apertures 18 depending on the desired fuel flow rate.

Figure 2:
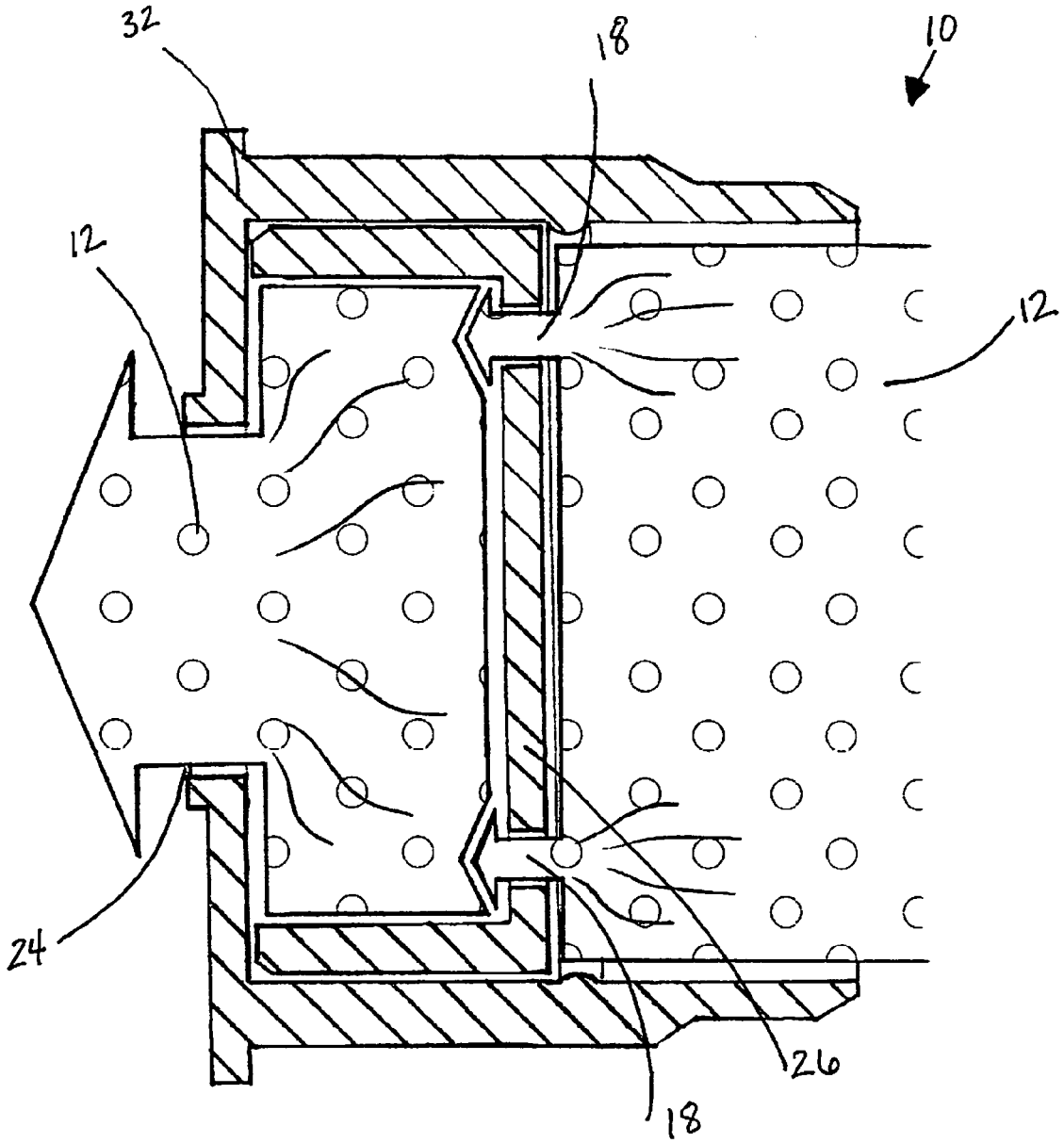
FIG. 2 is an enlarged sectional view of the container-mounted dispensing structure of FIG. 1 having directional arrows which indicate the movement of the fuel.
Figure 3:
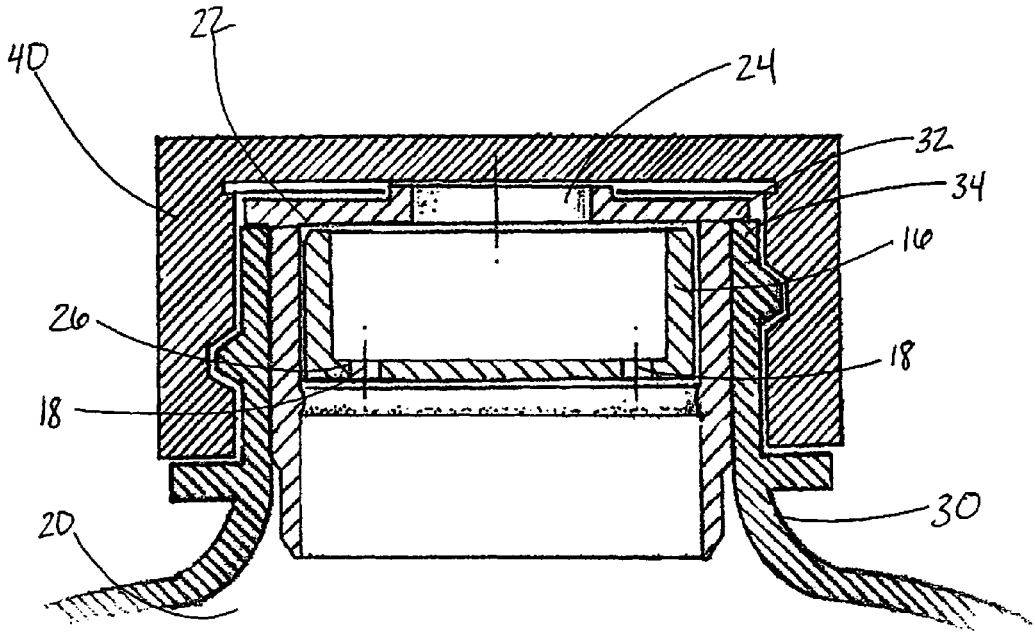
FIG. 3 is a less enlarged sectional view of the container-mounted dispensing structure of FIG. 1 positioned in the fuel container, showing among other things, a cover positioned over the container-mounted dispensing structure.

FIGS. 1-3 illustrate that upstream member 16 and downstream member 22 have annular sidewalls 28 sized such that upstream member 16 is friction-engaged with downstream member 22. FIGS. 1-3 also illustrate that sidewalls 28 of downstream member 22 are sized for friction engagement in the neck 30 of fuel container 20.

FIG. 2, through the use of directional arrows, illustrates the exit path of fuel 12 from the fuel container 20 through the flame-restricting apertures 18 and out of the container mounting dispensing structure 10 through the dispensing aperture 24.

Figure 4:
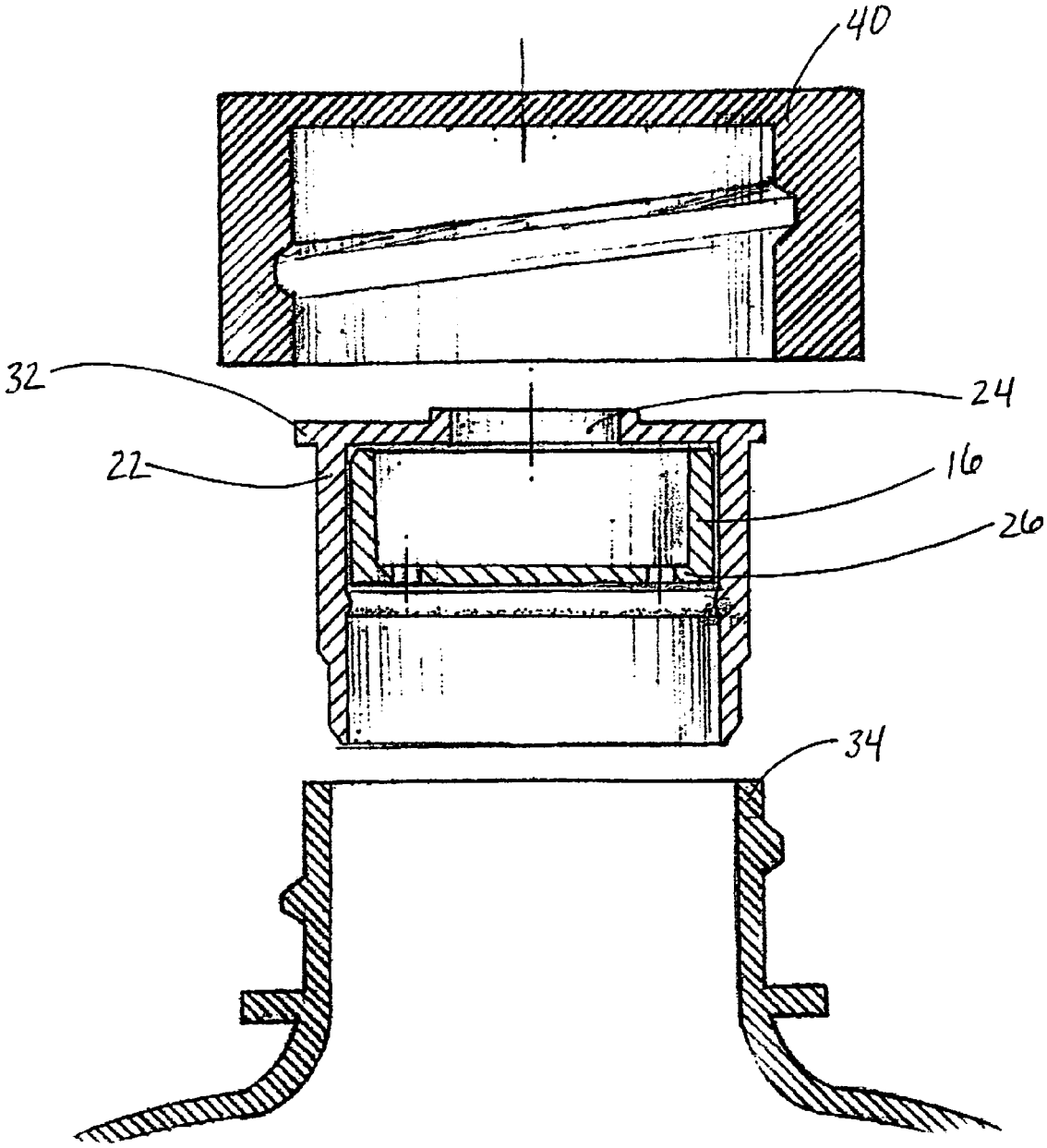
FIG. 4 is an exploded view of the device of FIG. 3, but with two members of the container-mounted dispensing structure assembled.

FIG. 4 is an exploded view illustrating container mounting dispensing structure 10 removed from neck 30 of fuel container 20. FIG. 4 also shows cover 40 which fits over container mounting dispensing structure 10 and while in place cover 40 prevents fuel 12 from exiting through dispensing aperture 24.

Figure 5:
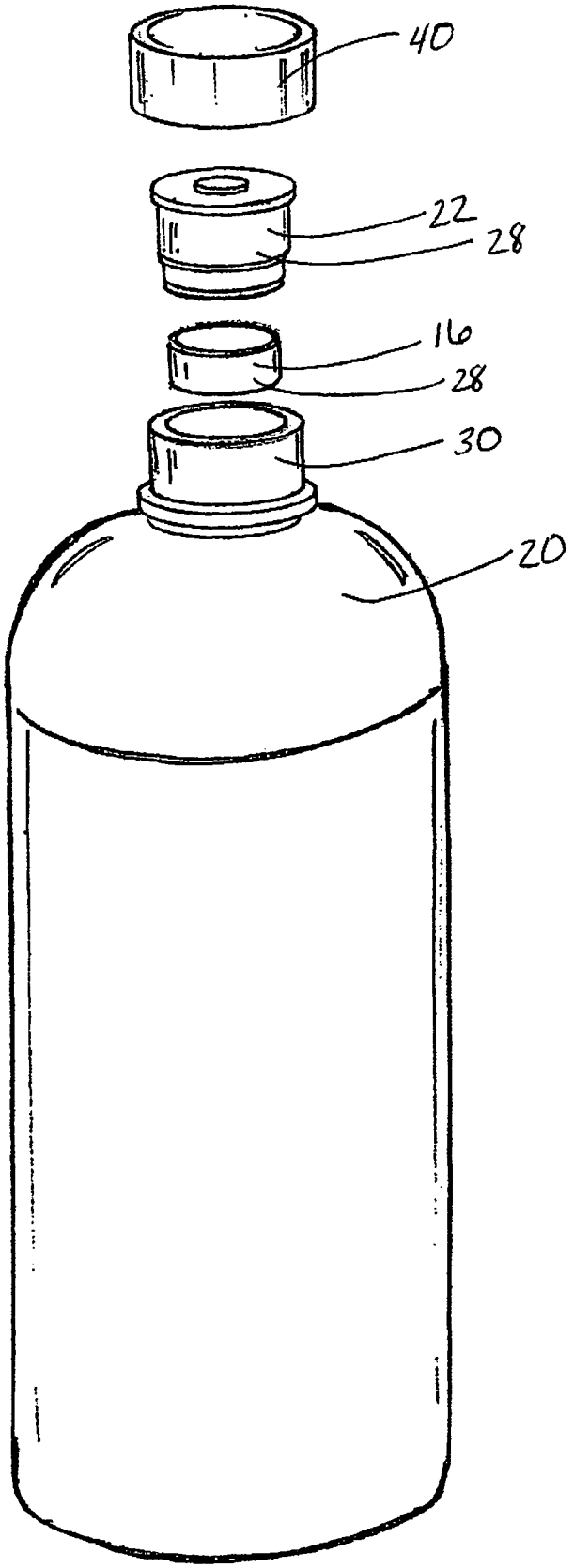
FIG. 5 is a fully-exploded perspective view of the container-mounted dispensing structure of FIG. 1.

FIG. 5 illustrates the interaction between cover 40, downstream member 22, upstream member 16 and neck 30 of fuel container 20.

Figure 7:
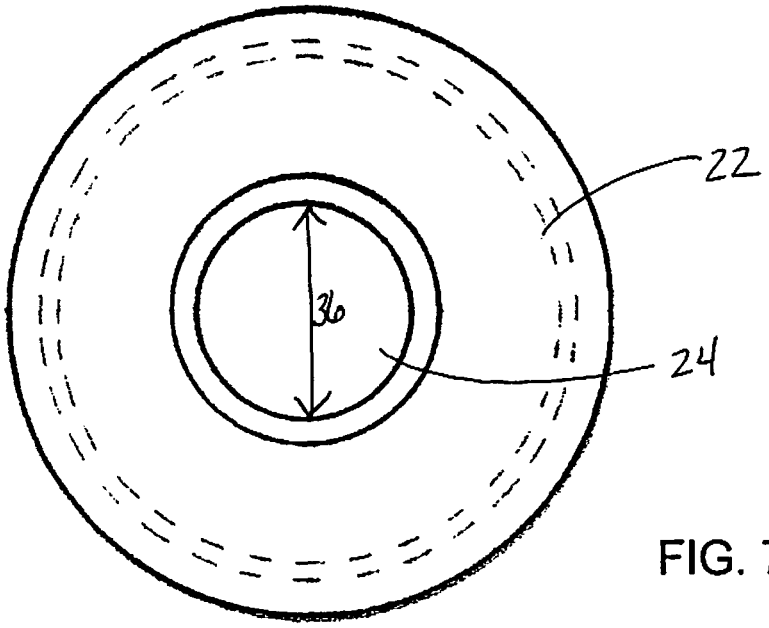
FIG. 7 is a top view of the downstream member of the container-mounted dispensing structure with dispensing aperture.
Figure 8:
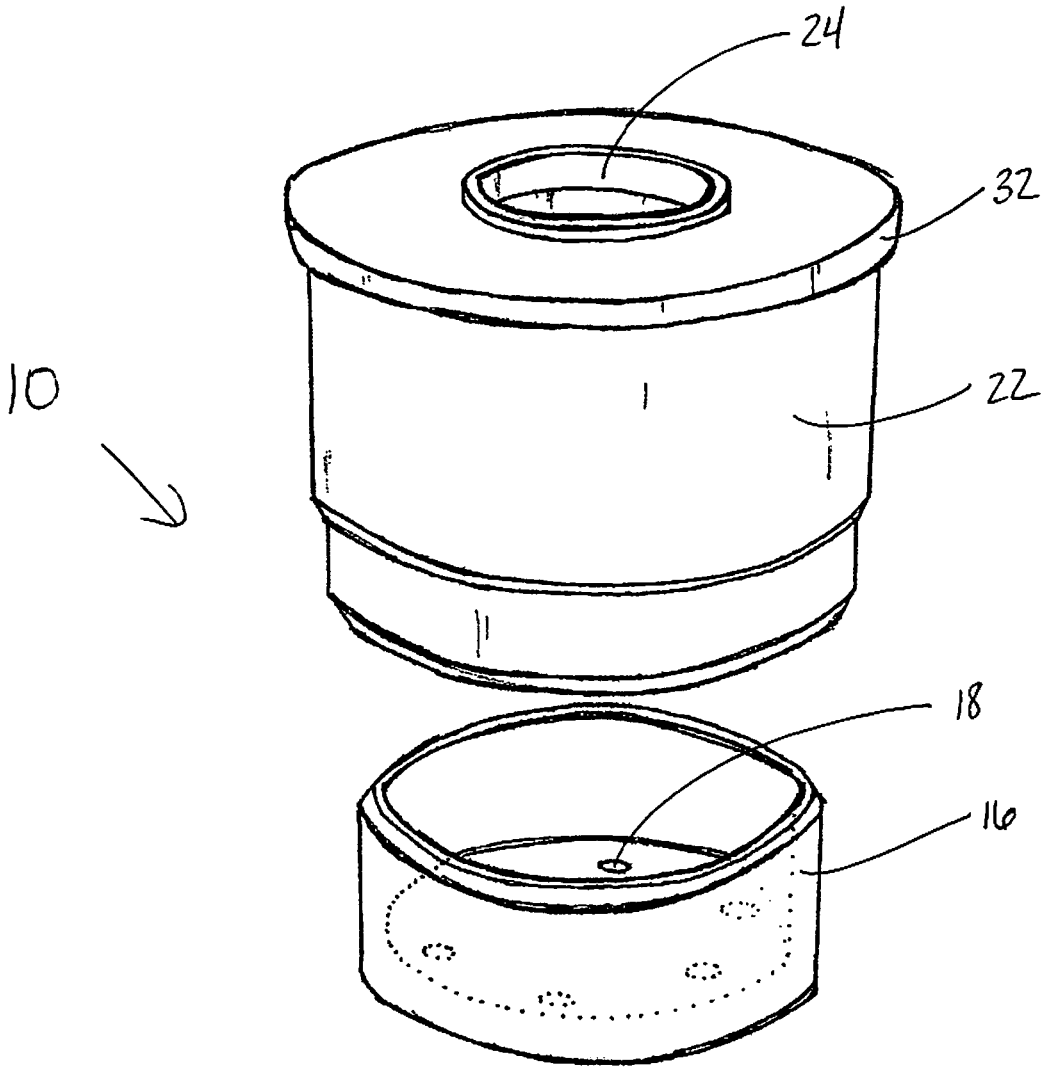
FIG. 8 is an exploded perspective view of the container-mounted dispensing structure of FIG. 1.
Figure 9:
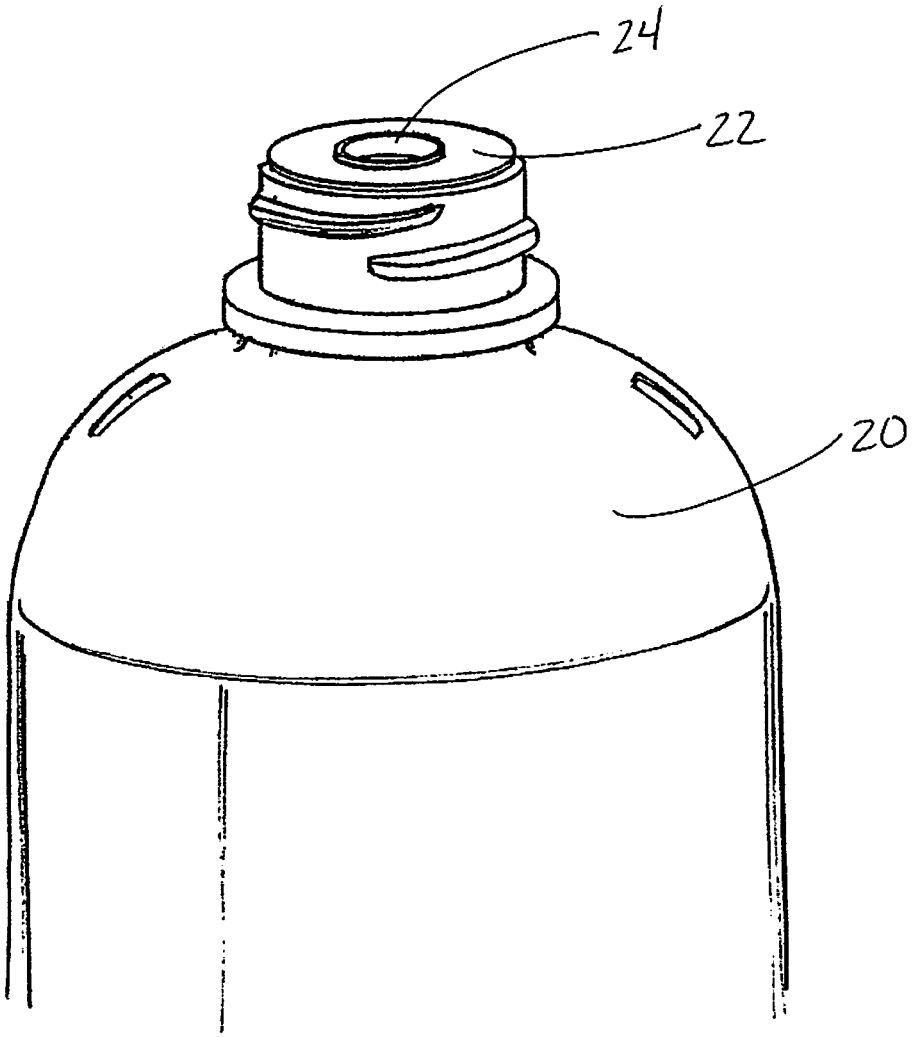
FIG. 9 is a perspective view of the container-mounted dispensing structure of FIG. 1 inserted into the neck of the fuel container, but with the screw cover removed.

FIGS. 7-9 illustrate dispensing aperture 24. In some embodiments, the inner diameter of dispensing aperture 36 is between 0.25 and 0.4 inches. Preferably, inner diameter of dispensing aperture 36 is about 0.35 inches.

As illustrated best in FIG. 6, inner diameter of flame-restricting apertures 38 are between 0.05-0.06 inches. Preferably, inner diameter of flame-restricting apertures 38 is about 0.058 inches.

Downstream member 22 includes an outward flange 32 positioned for engagement with the lip 34 of the fuel container 20 as seen in FIGS. 2-5 and 8-9. FIG. 9 illustrates container mounting dispensing structure 10 inserted into neck 30 of fuel container 20.

Container mounting dispensing structure 10 can be utilized with fuel containers 20 of many different shapes and sizes. Container mounting dispensing structure 10 can also be utilized with various types of liquid and gel fuels. While many types of liquid fuel can be used it is preferable to use a fuel such as isopropanol and ethanol in a liquid form.

The container mounting dispensing structure 10 of this invention is preferably fabricated of a plastic such as low density polyethylene but it can also be made of a heat resistant plastic. Container mounting dispensing structure 10 can also be made of metal, however, this is not preferred.

While the principles of this invention have been described in connection with specific embodiments, it should be understood clearly that these descriptions are made only by way of example and are not intended to limit the scope of the invention.

The invention claimed is:

1. A container-mounted dispensing structure for dispensing gel fuel into a gel-fuel containment reservoir of a ventless fireplace, the container having a body for a supply of gel fuel and a neck atop the body, the dispensing structure comprising:

a first member at the inner surface of the neck, the first member having a distal end wall and an annular sidewall and defining a downstream always unblocked dispensing aperture; and a second member having a lower edge and an annular sidewall projecting toward the distal end of the first member, the second member engaged to and within the first member and defining a plurality of upstream flame-restricting apertures through which fuel flows from the supply, the first and second members together forming a gel-fuel-gathering manifold between the upstream and downstream apertures, the downstream dispensing aperture being larger than the upstream flame-restricting apertures, the number and size of the flame restricting apertures are selected to (1) prevent flame ingress into the container and (2) allow sufficient flow into the manifold to facilitate single-stream, splash-free flow of gel fuel from the dispensing aperture into the reservoir, the first member having at least one inwardly-projecting annular bead adjacent to the lower edge to maintain the second member in fixed position relative to the first member, whereby the height of the annular sidewall of the second member is substantially the same as the distance between the bead and the distal end wall of the first member.

2. The dispensing structure of claim 1 wherein the annular sidewall of the second member is friction-engaged with the annular sidewall of the first member.

3. The dispensing structure of claim 2 wherein the sidewall of the first member is sized such that it is friction-engaged with the neck of the container.

4. The dispensing structure of claim 3 wherein the first member includes an outward flange positioned for engagement with the lip of the container neck.

5. The dispensing structure of claim 1 wherein the inner diameter of the downstream dispensing aperture is between 0.25 and 0.4 inches.

6. The dispensing structure of claim 5 wherein the inner diameter of the downstream dispensing aperture is 0.35 inches.

7. The dispensing structure of claim 1 wherein the inner diameters of the upstream flame-restricting apertures are between 0.05 and 0.06 inches.

8. The dispensing structure of claim 7 wherein the inner diameters of the upstream flame-restricting apertures are 0.058 inches.

9. The dispensing structure of claim 1 wherein the second member has at least six upstream flame-restricting apertures.

10. The dispensing structure of claim 1 further including a cover positioned over the first member.

11. The dispensing structure of claim 10 wherein the cover is a screw cap engaging the outer surface of the neck.

12. A dispensing structure for dispensing gel fuel into a gel-fuel containment reservoir of a ventless fireplace, the dispensing structure being mountable on a container having a body for a supply of gel fuel and a neck atop the body, the dispensing structure comprising:

a first member engageable with the inner surface of the neck, the first member having a distal end wall and an annular sidewall and defining a downstream always unblocked dispensing aperture; and a second member having a lower edge and an annular sidewall projecting toward the distal end of the first member, the second member engaged to and within the first member and defining a plurality of upstream flame-restricting apertures through which fuel flows from the supply, the first and second members together forming a gel-fuel-gathering manifold between the upstream and downstream apertures, the downstream dispensing aperture being larger than the upstream flame-restricting apertures, the number and size of the flame restricting apertures are selected to (1) prevent flame ingress into the container and (2) allow sufficient flow into the manifold to facilitate single-stream, splash-free flow of gel fuel from the dispensing aperture into the reservoir, the first member having at least one inwardly-projecting annular bead adjacent to the lower edge to maintain the second member in fixed position relative to the first member, whereby the height of the annular sidewall of the second number is substantially the same as the distance between the bead and the distal end wall of the first member.

13. The dispensing structure of claim 12 wherein the annular sidewall of the second member is friction-engaged with the annular sidewall of the first member.

14. The dispensing structure of claim 13 wherein the sidewall of the first member is sized for friction-engagement with the neck of the container.

15. The dispensing structure of claim 13 wherein the first member includes an outward flange positioned for engagement with the lip of the container neck.

16. The dispensing structure of claim 12 wherein the inner diameter of the downstream dispensing aperture is between 0.25 and 0.4 inches.

17. The dispensing structure of claim 16 wherein the inner diameter of the downstream dispensing aperture is 0.35 inches.

18. The dispensing structure of claim 16 wherein the inner diameters of the upstream flame-restricting apertures are between 0.05 and 0.06 inches.

19. The dispensing structure of claim 18 wherein the inner diameter of the downstream dispensing aperture is 0.35 inches.

20. The dispensing structure of claim 19 wherein the inner diameters of the upstream flame-restricting apertures are 0.058 inches.

21. The dispensing structure of claim 20 wherein the second member has at least six upstream flame-restricting apertures.

22. The dispensing structure of claim 12 wherein the inner diameters of the upstream flame-restricting apertures are between 0.05 and 0.06 inches.

23. The dispensing structure of claim 22 wherein the inner diameters of the upstream flame-restricting apertures are 0.058 inches.

24. The dispensing structure of claim 12 wherein the second member has at least six upstream flame-restricting apertures.

* * * * *